US005927810A

United States Patent [19]

Liao

[11] Patent Number: 5,927,810

[45] Date of Patent: Jul. 27, 1999

[54] ADJUSTABLE MUSICIAN'S CHAIR

[75] Inventor: Tsun-Chi Liao, Taichung, Taiwan

[73] Assignee: HWA Hsin Musical Instrument Co., Ltd., Taichung, Taiwan

[21] Appl. No.: 09/120,726

[22] Filed: Jul. 23, 1998

[51] Int. Cl.[6] ..... A47C 1/02

[52] U.S. Cl. ..... 297/344.12; 248/405

[58] Field of Search ..... 297/311, 338, 297/451.2, 344.12, 344.18; 248/125.8, 161, 405, 157, 188.4, 188.5

[56] References Cited

U.S. PATENT DOCUMENTS 1,184,886 5/1916 Spalding ..... 297/338 X 5,842,742 12/1998 Hoshino ..... 297/338

*Primary Examiner*—Milton Nelson, Jr.

*Attorney, Agent, or Firm*—Bacon & Thomas, PLLC

[57] ABSTRACT

A musician's chair includes a stand, the stand having a top barrel, a locating ring spaced below the top barrel, and a sleeve connected between the top barrel and the locating ring, a seat with a threaded seat stem inserted into the sleeve of the stand, a seat stem holding down device connected to the top barrel and controlled to hold down the seat stem against vibration, and a seat stem fixture supported on the seat stem holding down device and controlled to fix the seat stem at the desired elevation, wherein the seat stem holding down device includes a fixed plate integral with the barrel of the stand, a movable plate hinged to the fixed plate at one side, and a fastener fastened to the movable plate and the fixed plate to fix the movable plate and the fixed plate in a closed condition, causing the seat stem of the seat to be held down in a hole at a horizontal top wall of the fixed plate.

1 Claim, 6 Drawing Sheets

ADJUSTABLE MUSICIAN'S CHAIR

BACKGROUND OF THE INVENTION

The present invention relates to a musician's chair, and more particularly to such a musician's chair that can be conveniently and quickly adjusted to the desired elevation and firmly secured against vibration.

A prior art musician's seat, as shown in FIG. 1, is generally comprised of a stand having a top barrel, a locating ring spaced below the top barrel, and a sleeve connected between the top barrel and the locating ring, a seat with a threaded seat stem threaded into a connector at the top of the sleeve of the stand, and a seat stem lock controlled to lock the seat stem at the desired elevation. The seat stem lock, as shown in FIG. 1, comprises a shell threaded onto the threaded seat stem of the seat and covered on the connector at the top of the sleeve, and a tightening up screw threaded into a radial screw hole and stopped against the periphery of the connector to fix the shell in place. When adjusting the elevation of the seat, the tightening up screw is loosened, and then the seat is rotated upwards or downwards to the desired elevation. Because the threaded seat stem of the seat cannot be moved axially linearly in the connector and the shell, it takes much time to adjust the elevation of the seat.

SUMMARY OF THE INVENTION

It is one object of the present invention to provide a musician's chair which enables the user to rapidly adjust the elevation of the seat. It is another object of the present invention to provide a musician's chair which firmly stops the seat from vibration. To achieve these and other objects of the present invention, there is provided a musician's chair comprised of a stand the having a top barrel, a locating ring spaced below the top barrel, and a sleeve connected between the top barrel and the locating ring, a seat with a threaded seat stem inserted into the sleeve of the stand, a seat stem holding down device connected to the top barrel and controlled to hold down the seat stem against vibration, and a seat stem fixture supported on the seat stem holding down device and controlled to fix the seat stem at the desired elevation and to stop the seat stem from axial movement in the sleeve. The seat stem holding down device comprises a fixed plate integral with the barrel of the stand, a movable plate hinged to the fixed plate at one side, and a fastener fastened to the movable plate and the fixed plate to fix the movable plate and the fixed plate in a closed condition, so that the seat stem is held down in a hole at a horizontal top wall of the fixed plate.

DETAILED DESCRIPTION OF THE PREFERRED EMBODIMENT

Figure 1:
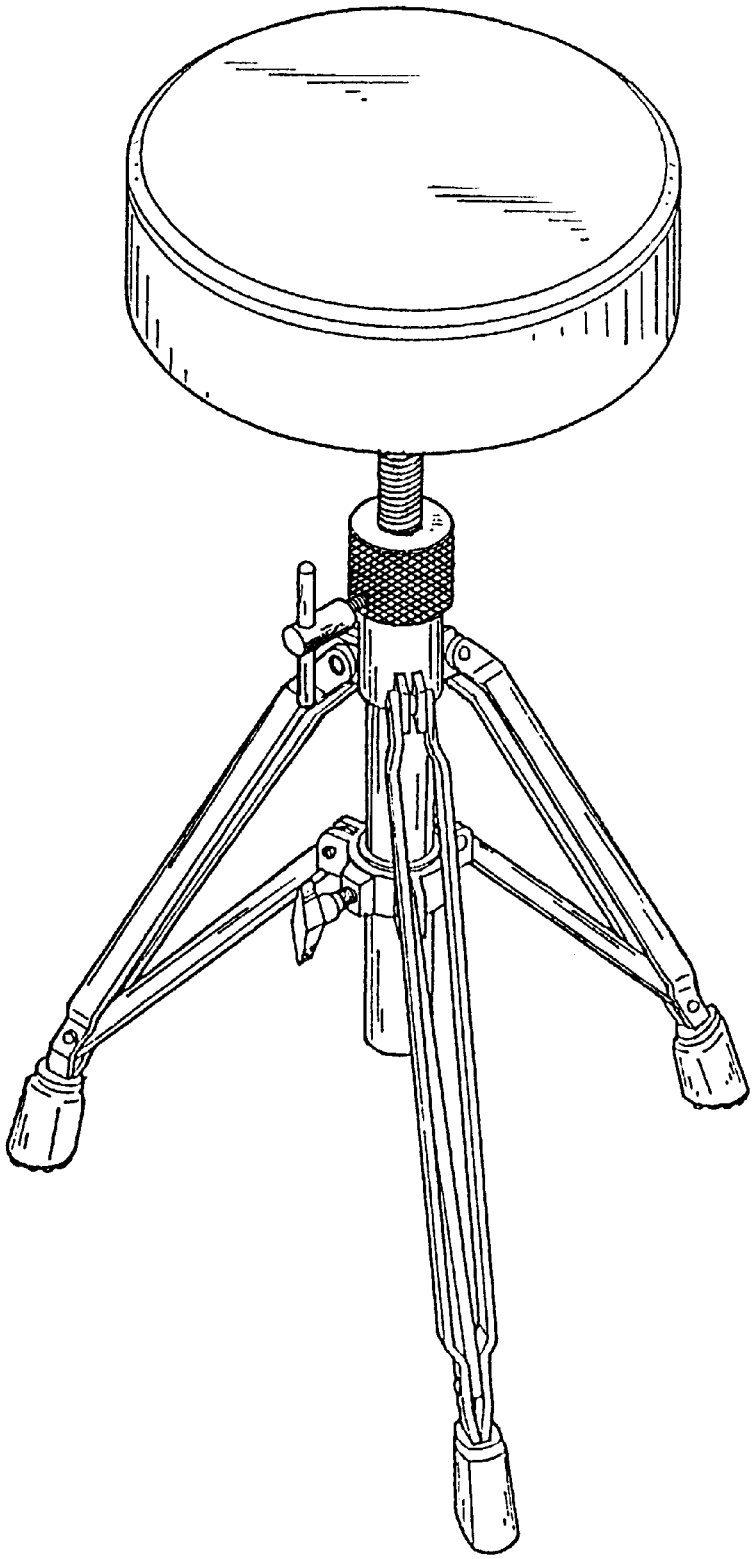
Fig.1 PRIOR ART
FIG. 1 is a perspective view of a musician's chair according to the prior art.
Figure 2:
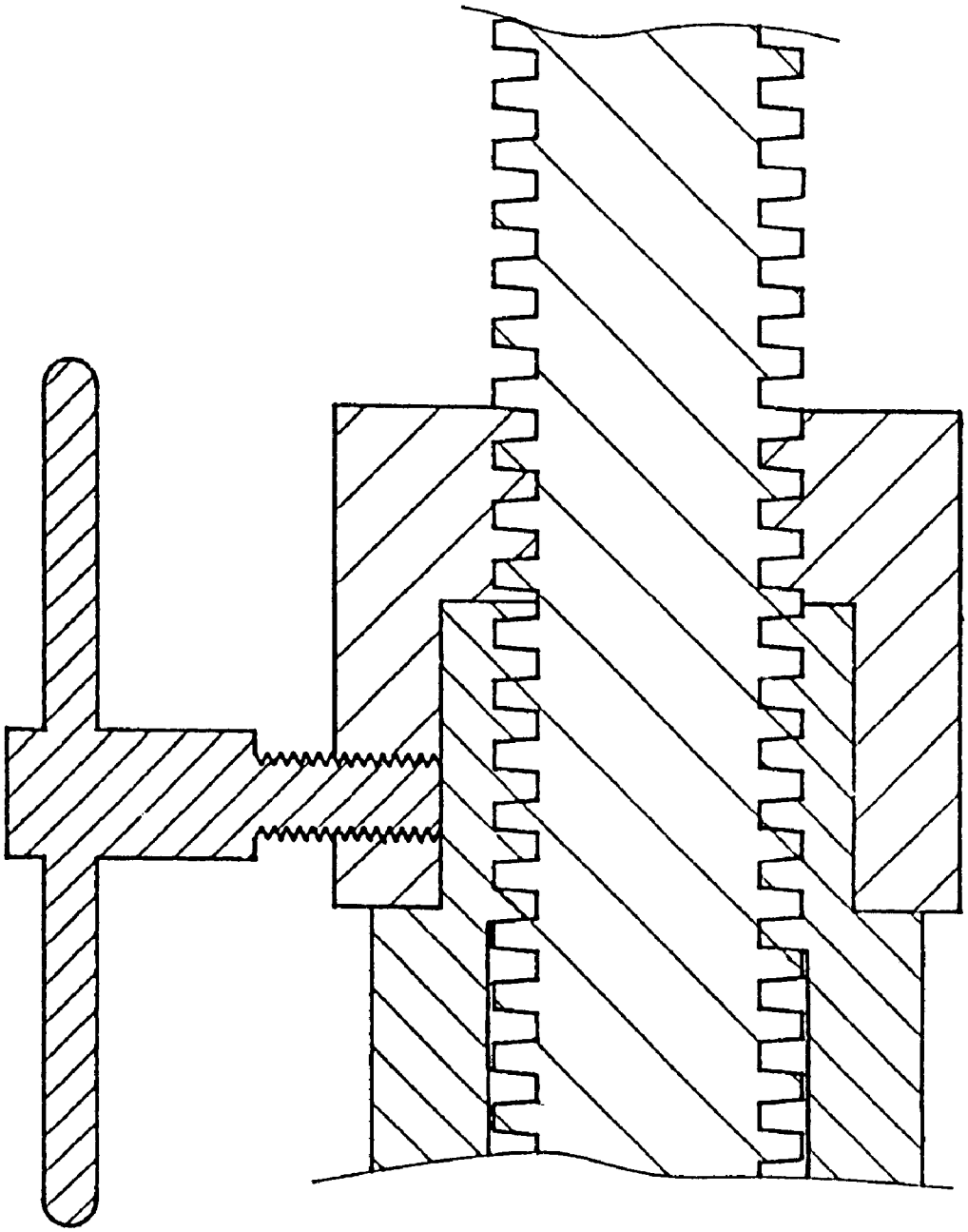
Fig.2 PRIOR ART
FIG. 2 is an enlarged sectional view of a part of FIG. 1 showing the shell mounted on the connector around the threaded seat stem, the tightening up screw fastened to the shell and stopped against the connector.

Referring to Figures From 3 through 7, a musician's chair in accordance with the present invention comprises a stand 20, a seat 30, a seat stem fixture 40, and a seat stem holding down device 50.

Figure 4:
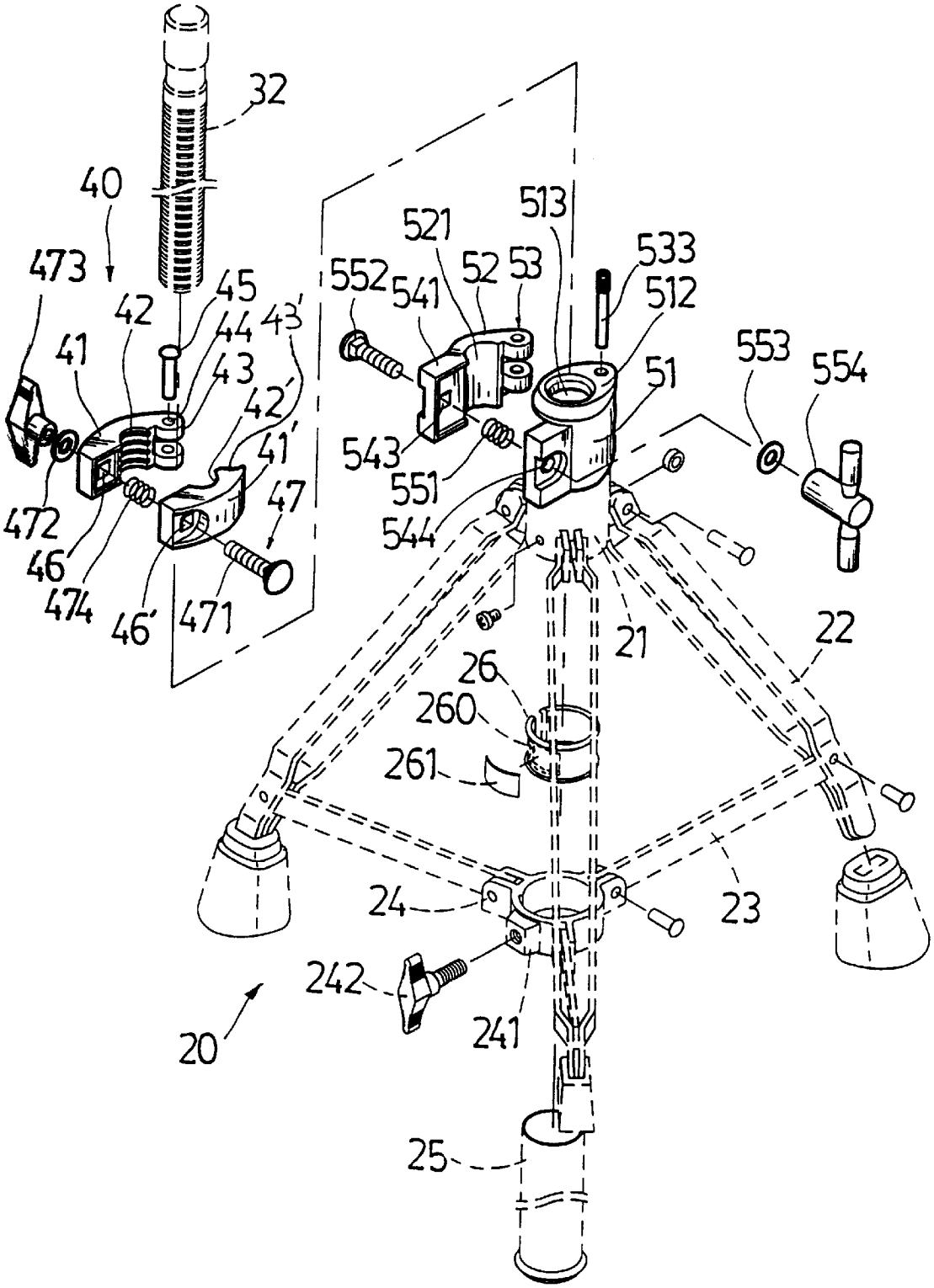
FIG. 4 is an exploded perspective view of a musician's chair constructed according to the present invention (the seat excluded).
Figure 5:
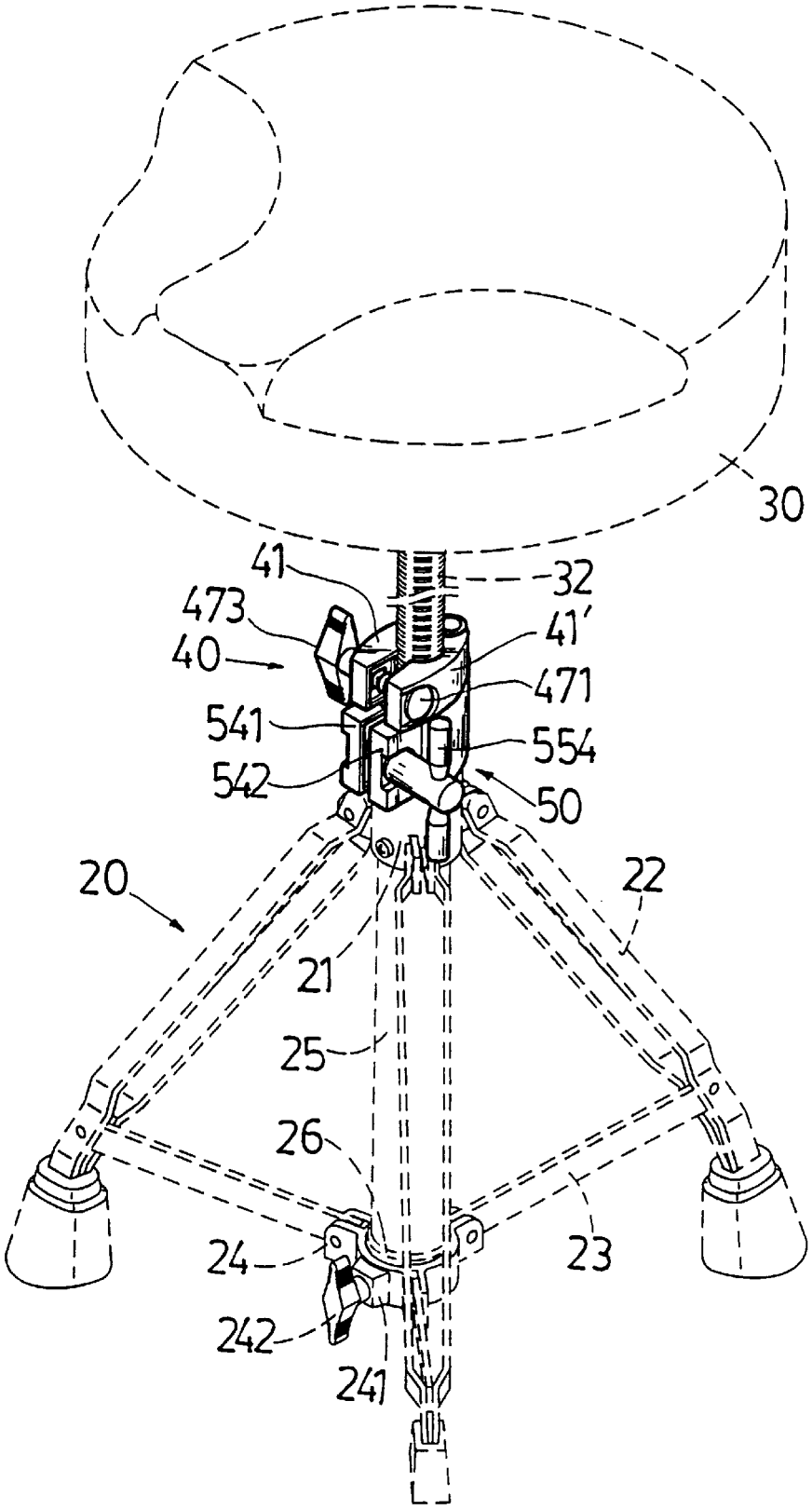
FIG. 5 is a perspective view of the present invention in an assembled condition.
Figure 7:
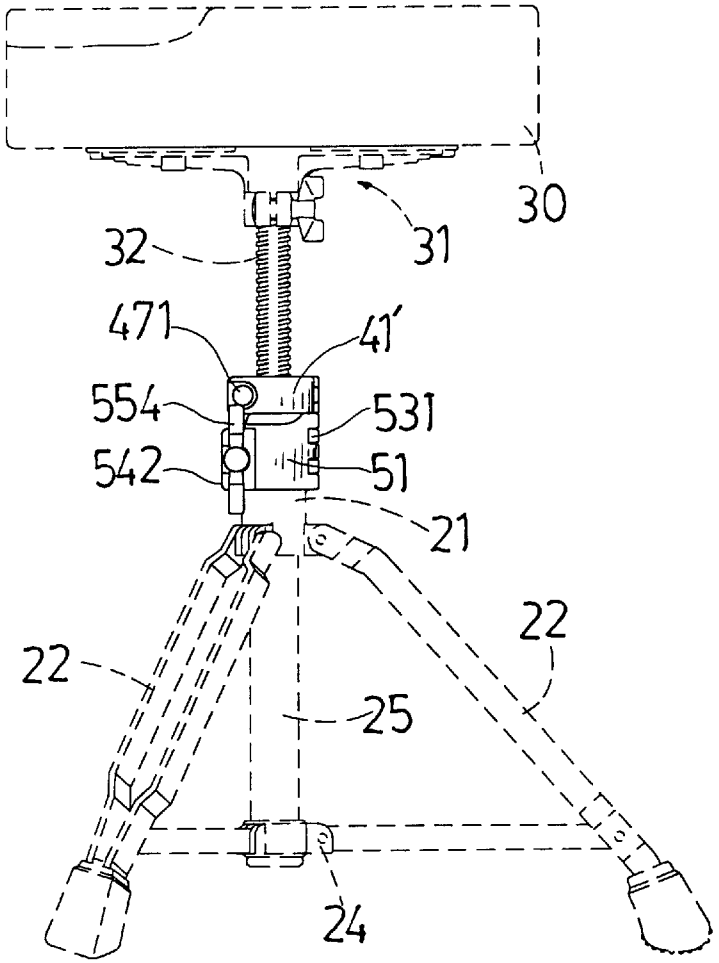
FIG. 7 is another side view of the musician's chair shown in FIG. 6.

Referring to FIGS. 4 and 5, the stand 20 comprises a barrel 21, a locating ring 24 spaced below the barrel 21, a plurality of legs 22 respectively obliquely connected to the periphery of the barrel 21, a plurality of stretchers 23 respectively connected between the legs 22 and the locating ring 24, a sleeve 25 connected between the locating ring 24 and the barrel 21, a split packing ring 26 mounted within the locating ring 24 around the sleeve 25, a smoothly arched friction plate 261 mounted within a peripheral opening 260 on the split packing ring 26 and retained between the inside wall of the locating ring 24, and a tightening up screw 242 threaded into a screw hole 241 on the locating ring 24 and stopped at the friction plate 261 against the sleeve 25 to fix the sleeve 25 in place.

Figure 6:
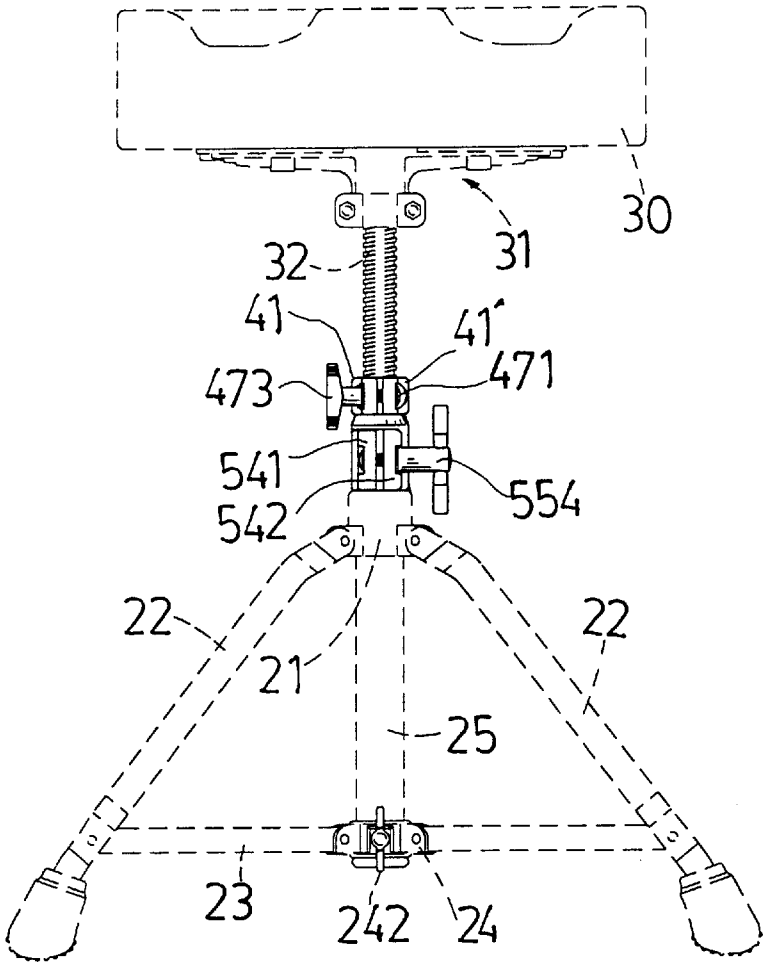
FIG. 6 is a side view of a musician's chair constructed according to the present invention.

Referring to FIGS. 5 and 6, the seat 30 comprises a bottom frame 31, and a threaded seat stem 32 perpendicularly downwardly extended from the bottom frame 31 at the center and inserted into the sleeve 25 of the stand 20 (see FIG. 6).

Referring to FIGS. 4 and 5, the seat stem fixture 40 comprises a first arched base block 41 and a second arched base block 41'. The arched base blocks 41,41' each have vertically spaced axle housings 43,43' at one end namely the fixed end, a transverse through hole 46,46' at an opposite end namely the free end, and a threaded engagement portion 42 at an inner side between the axle housings 43,43' and the through hole 46,46'. The axle housings 43,43' of the arched base blocks 41,41' are pivotally connected together by a pivot pin 45 extending through a pair of aligned holes 44. A screw bolt 47 is mounted in the through holes 46,46' on the arched base blocks 41,41'. A wing nut 473 is threaded onto the threaded stem 471 of the screw bolt 47 to fix the free ends of the arched base blocks 41,41' together. A compression spring 474 is mounted around the threaded stem 471 of the screw bolt 47, and retained between the free ends of the arched base blocks 41,41'. When the screw bolt 47 and the wing nut 473 are tightly fastened together with a washer 472, the threaded engagement portions 42,42' of the arched base blocks 41,41' are firmly retained in engagement with the threaded stem 32 of the seat 30, and the threaded stem 32 of the seat 30 is stopped from axial movement relative to the seat stem fixture 40.

Figure 3:
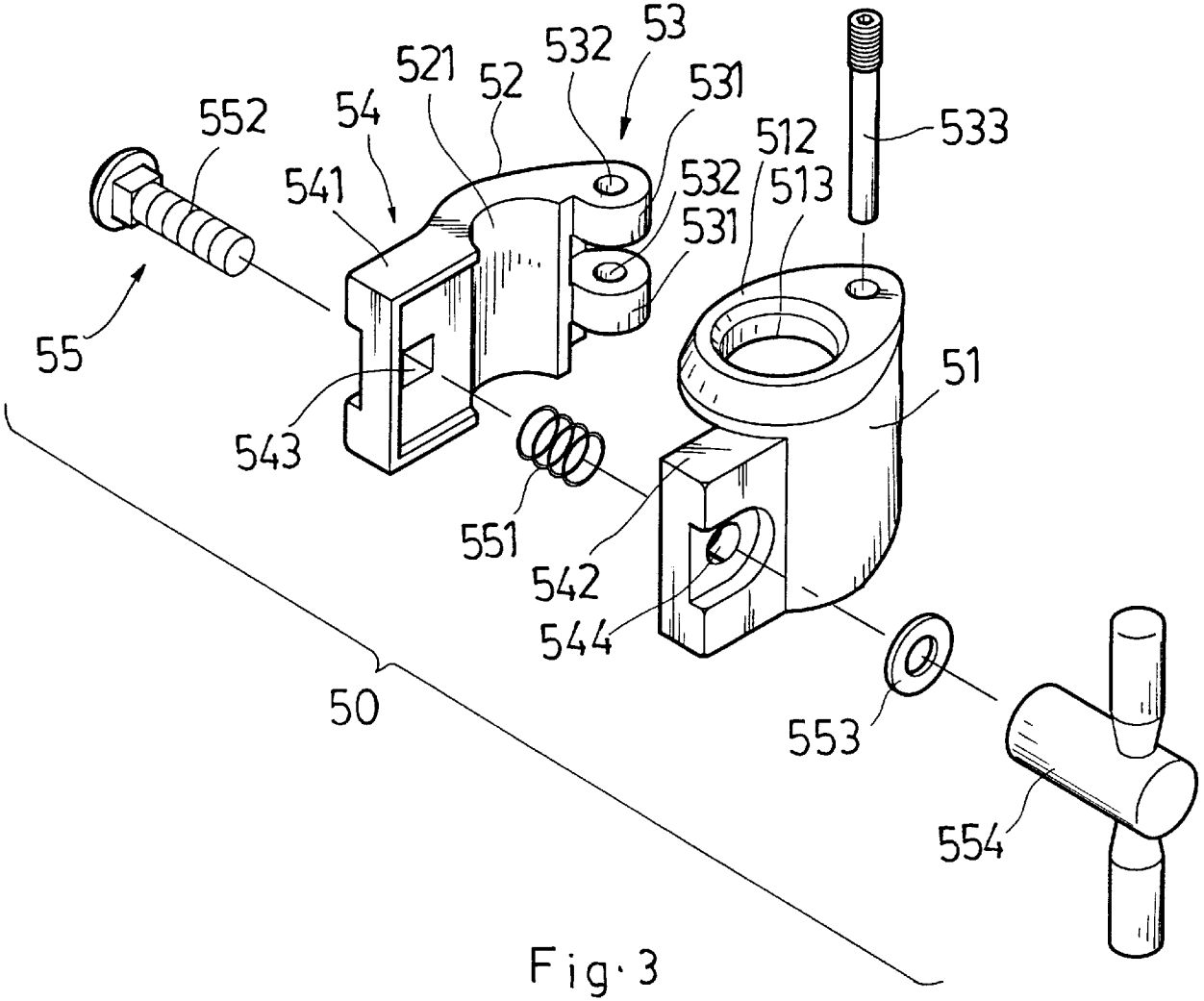
FIG. 3 is an exploded perspective view of a seat stem holding down device according to the present invention.

Referring to FIGS. 3, 4 and 5, the seat stem holding down device 50 comprises a fixed plate 51 integral with the barrel 21 of the stand 20 at the top, a movable plate 52 connected to the fixed plate 51 by a joint 53, a fastening unit 55, and a coupling structure 54 provided at the fixed plate 51 and the movable plate 52, enabling the fixed plate 51 and the movable plate 52 to be fastened up by the fastening unit 55 to hold down the threaded seat stem 32 of the seat 30. The fixed plate 51 and the movable plate 52 each have an axially extended U-shaped coupling groove 521 on an inner side at the middle of plate 51 and plate 52. The fixed plate 51 further comprises a horizontal top wall 512, and a round hole 513 at the horizontal top wall 512 in line with the axially extended coupling groove 521 thereof. The joint 53 comprises a pivot pin 533 axially mounted on the fixed plate 51 at one lateral side, a plurality of vertically spaced lugs 531 integral with the movable plate 52 at one lateral side and respectively coupled to the pivot pin 533. The lugs 531 each have a pivot hole 532, which receives the pivot pin 533. The coupling structure comprises two coupling flanges 541,542 respectively integral with the movable plate 52 and the fixed plate 51 at one lateral side remote from the joint 53, a first through hole 543 and a second through hole 544 respectively provided at the coupling flanges 541,542. The fastening unit 55 comprises a screw bolt 552 inserted through the through holes 543,544 on the coupling flanges 541,542, a compression spring 551 mounted around the screw bolt 552 and stopped between the coupling flanges 541,542, a hand nut 554 threaded onto the screw bolt 552 to fix the coupling flanges 541,542 together, and a washer 553 mounted around the screw bolt 552 and stopped between the second coupling flange 542 and the hand nut 554.

Referring to FIGS. 4, 5, 6 and 7, the seat stem fixture 40 is mounted above the seat stem holding down device 50 around the threaded seat stem 32 of the seat 30, and the threaded seat stem 32 of the seat 30 is inserted through the round hole 513 of the fixed plate 51 into the sleeve 25 of the stand 20. When the wing nut 473 and the screw bolt 47 are fastened tight, the threaded engagement portions 42,42' of the arched base blocks 41,41' are firmly retained in engagement with the threaded stem 32 of the seat 30 to prevent the threaded stem 32 of the seat 30 from axial movement in the sleeve 25. When the screw bolt 552 and the hand nut 554 are fastened tight, the fixed plate 51 and the movable plate 52 are tightly closed together to hold down the threaded seat stem 32 of the seat 30 in the round hole 513, and the threaded seat stem 32 of the seat 30 is stopped by the horizontal top wall 512 of the fixed plate 51 against vibration. When the wing nut 473 and the hand nut 554 are respectively loosened, the threaded seat stem 32 can then be smoothly moved with the seat 30 in the sleeve 25 of the stand 20 to the desired elevation.

What I claim is:

1. A musician's chair comprising:

a stand having a top barrel, a locating ring spaced below said top barrel, and a sleeve connected between said top barrel and said locating ring;

a seat having a threaded seat stem extending downwardly from a bottom side thereof and inserted into said top of said sleeve of said stand;

a seat stem holding down device connected to said top barrel of said stand at a top side for holding down the seat stem of said seat and preventing the seat stem of said seat from vibrating;

a seat stem fixture supported on said seat stem holding down device for fixing the seat stem of said seat at a desired elevation and preventing the seat stem from axial movement in said sleeve of said stand, wherein said seat stem holding down device comprises:

a fixed plate integral with said barrel of said stand, said fixed plate comprising a first lateral side, a second lateral side, a coupling flange extended from the second lateral side of said fixed plate, a through hole at the coupling flange of said fixed plate, an axially extended coupling groove on an inner side at a middle of said fixed plate for engagement with the periphery of the seat stem of said seat, a horizontal top wall, and a round hole at said horizontal top wall, the round hole receiving the seat stem of said seat;

a movable plate, said movable plate comprising a first lateral side hinged to the first lateral side of said fixed plate, a second lateral side, a coupling flange extended from the second lateral side of said movable plate, a through hole at the coupling flange of said movable plate, and an axially extended coupling groove on an inner side at a middle of said movable plate for engagement with the periphery of the seat stem of said seat; and a fastener mounted in the through holes of the coupling flanges of said fixed plate and said movable plate for fixing the coupling flanges together.

* * * * *